US006131316A

United States Patent [19]

Yoshina et al.

[11] Patent Number: 6,131,316

[45] Date of Patent: Oct. 17, 2000

[54] SNOW THROWER MACHINE

[75] Inventors: Atsuo Yoshina; Toshiaki Okanishi; Akihiro Ima, all of Amagasaki, Japan

[73] Assignee: Kanzaki Kokyukoki Mfg. Co., Ltd., Japan

[21] Appl. No.: 09/057,436

[22] Filed: Apr. 9, 1998

[30] Foreign Application Priority Data

Aug. 8, 1997 [JP] Japan ..... 9-214910

[51] Int. Cl.[7] ..... E01H 5/09

[52] U.S. Cl. ..... 37/242; 37/244; 60/435

[58] Field of Search ..... 37/242, 244, 249, 37/253, 254; 60/435, 458, 487; 91/499

[56] References Cited

U.S. PATENT DOCUMENTS

| | | | |
|---|---|---|---|
| 2,109,393 | 2/1938 | Bleu | 37/254 |
| 3,758,967 | 9/1973 | Thompson | 37/43 E |
| 4,085,833 | 4/1978 | Papasideris | 194/4 B |
| 4,123,857 | 11/1978 | Enters et al. | 37/43 E |
| 4,696,164 | 9/1987 | Giere | 60/485 |
| 5,000,302 | 3/1991 | Takeshita | 192/17 R |
| 5,020,250 | 6/1991 | Fujii et al. | 37/257 |
| 5,022,477 | 6/1991 | Wanie | 180/6.34 |
| 5,087,227 | 2/1992 | Giere et al. | 475/72 |
| 5,123,186 | 6/1992 | Matushita et al. | 37/251 |
| 5,377,487 | 1/1995 | Azuma et al. | 60/487 |
| 5,438,770 | 8/1995 | Miller | 37/227 |
| 5,513,453 | 5/1996 | Norton | 37/244 |
| 5,515,677 | 5/1996 | Irikura | 60/435 |
| 5,755,098 | 5/1998 | Irikura | 60/435 |
| 5,921,151 | 7/1999 | Louis et al. | 74/606 R |

FOREIGN PATENT DOCUMENTS 1-288663 11/1989 Japan .

*Primary Examiner*—Eileen D. Lillis
*Assistant Examiner*—Gary S. Hartmann
*Attorney, Agent, or Firm*—Sterne, Kessler, Goldstein & Fox PLLC

[57] ABSTRACT

A snow thrower machine having an axle driving unit comprising a housing, consisting of a front housing and a rear housing and containing an axle. Disposed in the housing are a hydraulic pump, which receives power from an engine, a hydraulic motor, which is driven by pressurized oil received from hydraulic pump and a center section, having a pump mounting surface parallel to a joint surface between the front housing and the rear housing. The axle is supported by the front housing below the hydraulic pump and a parking brake system for the axle driving unit is disposed above an expanded portion of the front housing, which contains the axle. The parking brake system is constructed so that a lock pin, supported by the housing, can be engaged with a lock member, fixed onto a motor shaft of the hydraulic motor.

5 Claims, 10 Drawing Sheets

SNOW THROWER MACHINE

BACKGROUND OF THE INVENTION

1. Field of the Invention

The present invention relates to a technique for driving the crawlers of a snow thrower machine by means of a stepless speed changing hydrostatic transmission (HST).

2. Related Art

A well-known, conventional technique for driving the crawlers of a snow thrower machine by means of an HST is disclosed in Japanese Provisional Publication No. 288663/89.

According to this conventional technique, output power is controlled by transmitting power from an engine to an input shaft of the HST through pulleys and a belt. The HST is disposed on an axle supporting housing and an output shaft thereof is inserted into the housing. The rotational speed of the output shaft is reduced by a gear train in the housing, which, in turn, drives the axles.

The above mentioned HST is fixed onto an outside surface of an upper portion of the housing, wherein the input and output shafts of the HST are disposed in a parallel relationship, one above the other. Additionally, bevel gears, plain gears and the like are disposed in the housing to form the reduction gear train that is connected to the output shaft. As a result, the housing must be lengthy in both the longitudinal and vertical directions and, therefore, is undesirably large.

Furthermore, there is no parking brake or parking brake incorporated into the power transmission system, so that even if the HST is in neutral, the snow thrower machine may skid, because of the idling of the crawlers on a slope or due to a leak of operating oil from a hydraulic motor within the HST.

SUMMARY OF THE INVENTION

An object of the present invention is to provide a compact snow thrower machine, which has crawlers driven by an HST.

Another object of the present invention is to provide a snow thrower machine, which has crawlers driven by an HST, which is prevented from skidding while in neutral when either the crawlers are idling on a slope or operating oil leaks from a hydraulic motor within the HST.

Further objects, features and advantages of the present invention will be more fully apparent from the following description.

DETAILED DESCRIPTION OF THE PREFERRED EMBODIMENTS

Figure 1:
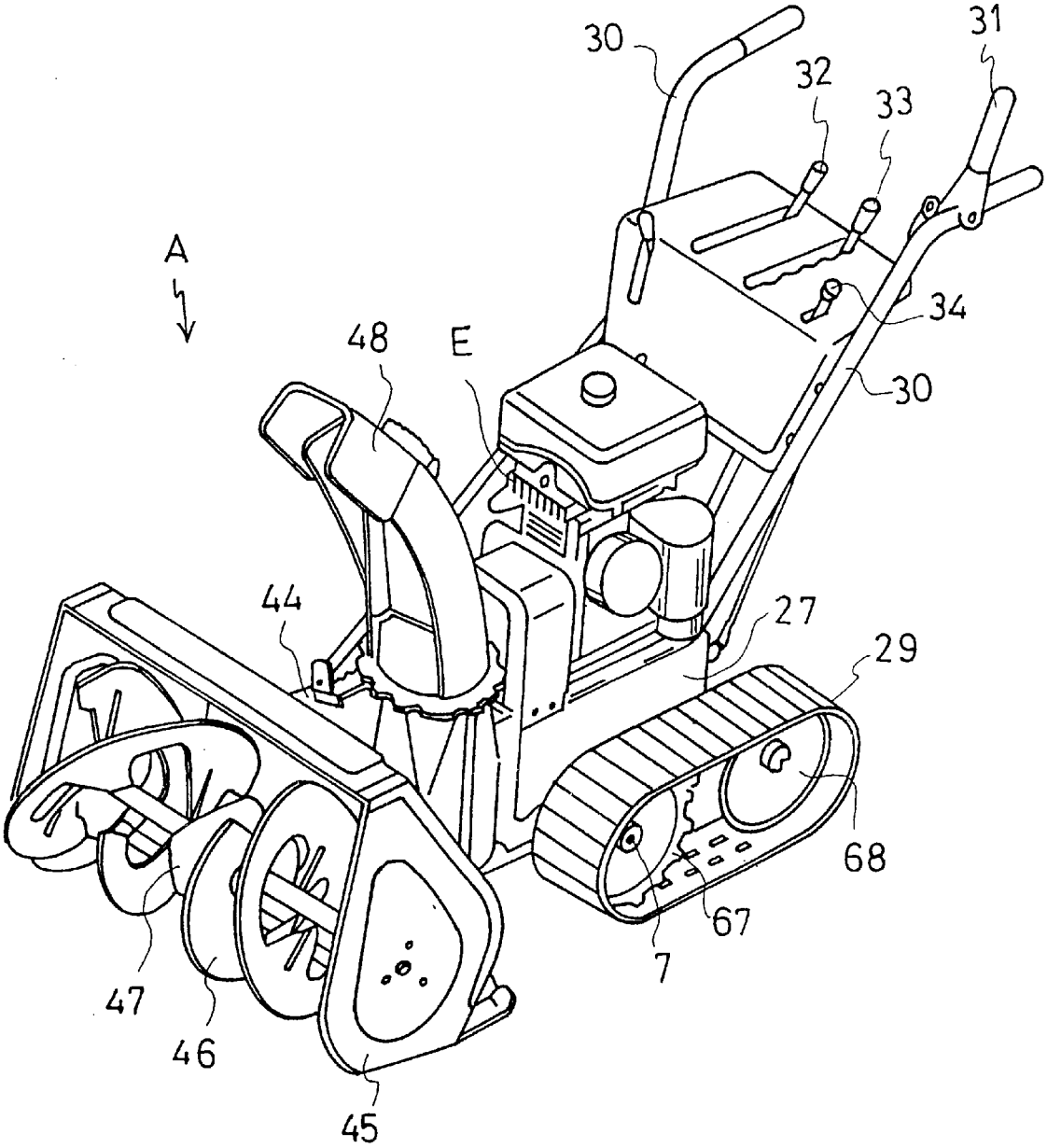
FIG. 1 is a perspective view of a snow thrower machine according to the present invention.

Explanation will be given of the entire construction of a walk-behind type snow thrower machine as shown in FIG. 1.

Figure 3:
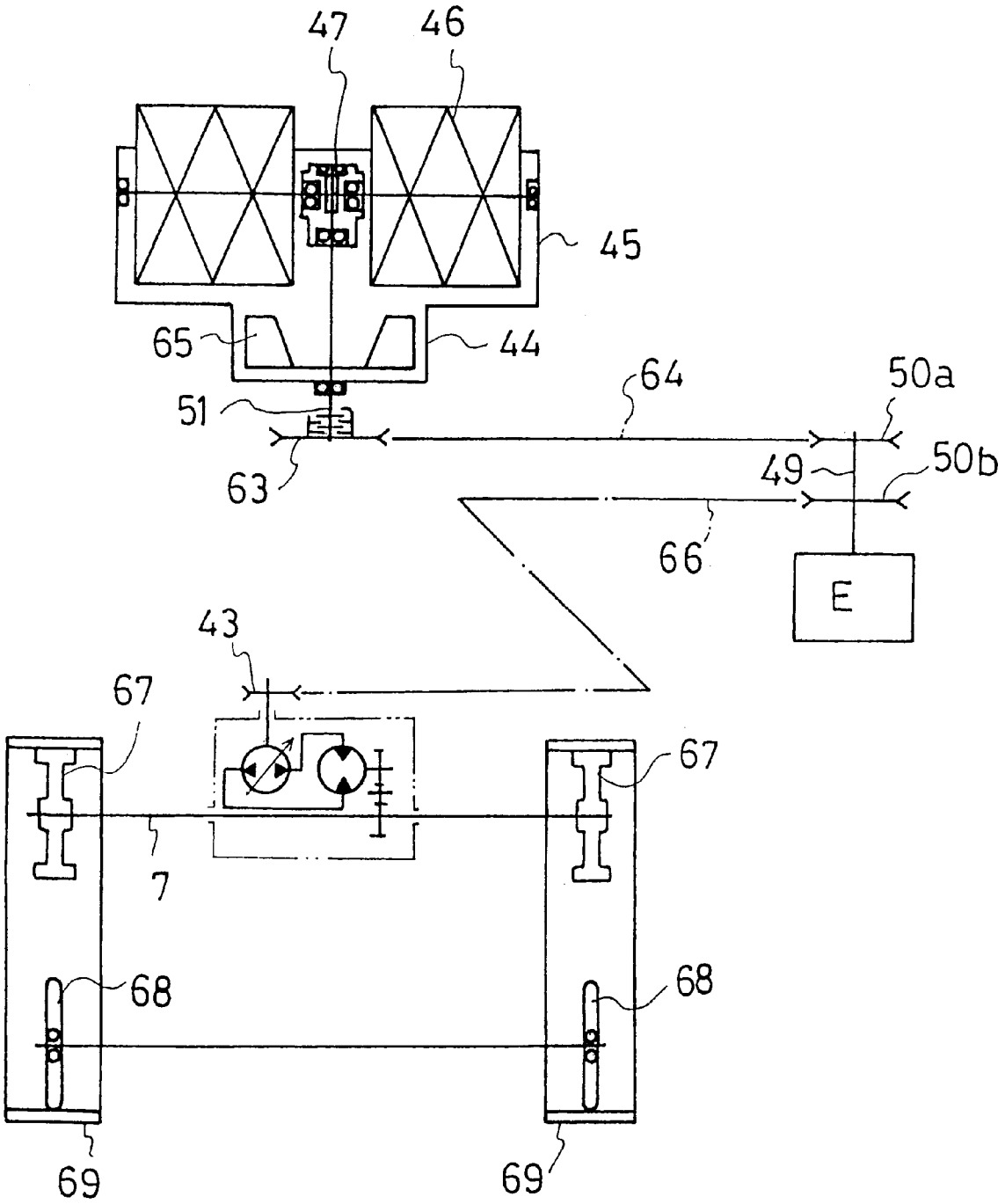
FIG. 3 is a diagram of a power transmission system for a snow thrower machine according to the present invention.

A pair of handles 30 project rearwardly from a body frame 27. A safety lever 31 is disposed on the rear portion of one of handles 30. A main clutch lever 32, a main speed changing lever 33, an accelerator lever 34 and the like are disposed between handles 30. An engine E is mounted on body frame 27. A snow thrower portion A is disposed in front of body frame 27. Snow thrower portion A is constructed so that an auger casing 45 is disposed in front of a blower casing 44. A scraping auger 46, having a lateral drive shaft, is disposed in auger casing 45 and a gearbox 47, for transmitting power to the drive shaft of scraping auger 46, is disposed at the lateral center of the drive shaft of scraping auger 46, as shown in FIG. 3. A chute 48 is disposed on the upper portion of blower casing 44.

Figure 2:
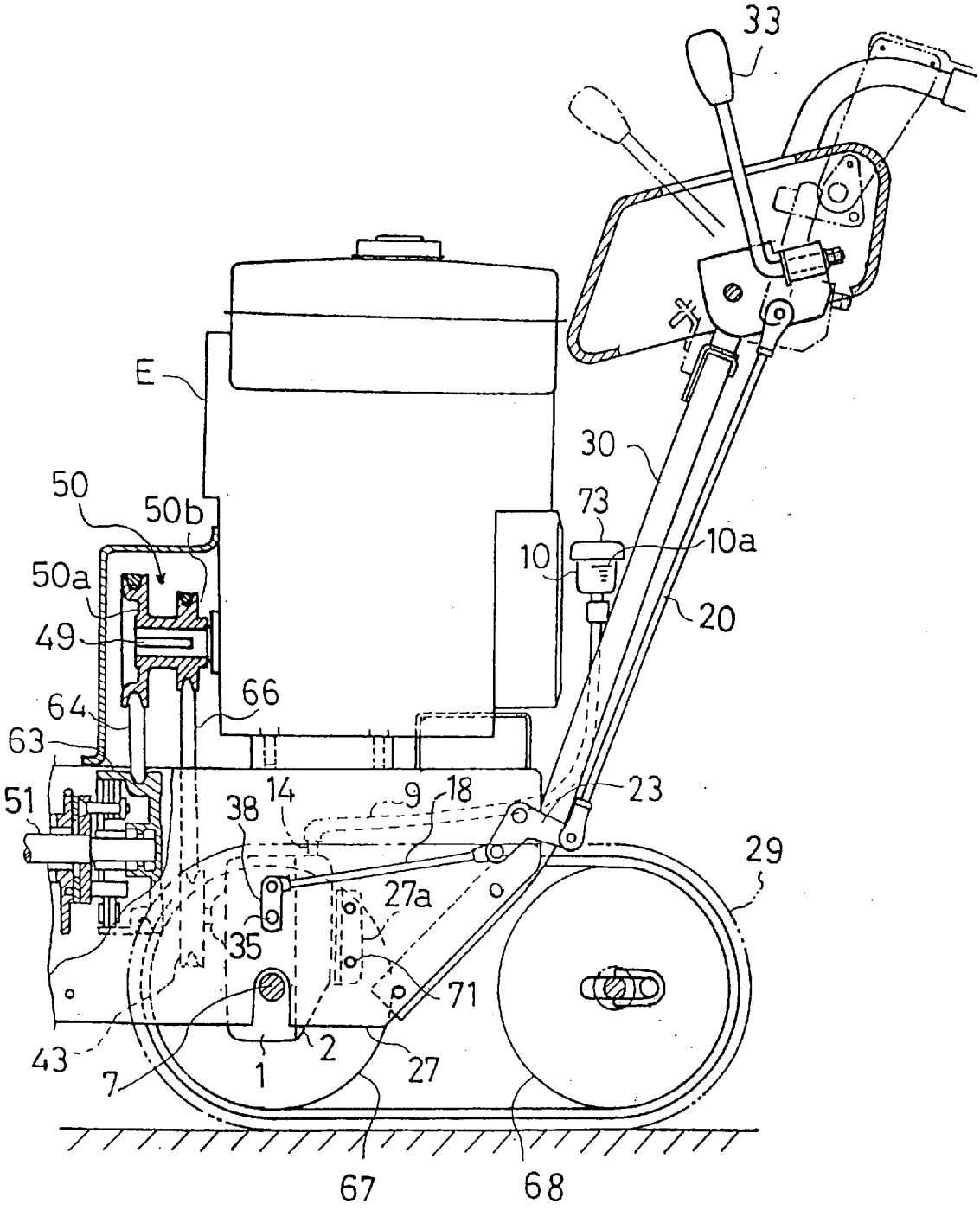
FIG. 2 is a cross-sectional side view of a snow thrower machine according to the present invention, showing the circumference of the crawlers.

As shown in FIGS. 2 and 3, an output shaft 49 of engine E is disposed longitudinally with respect to the machine body. Double output pulley 50 is fixed onto output shaft 49. A blower shaft 51 is disposed longitudinally within blower casing 44 and a pulley 63, containing a clutch, is fixed thereto. A belt 64 is bound between pulley 63 and one pulley 50*a* of double output pulley 50, so that a blower 65 and scraping auger 46 can be driven by power from engine E. A belt 66 is bound between the other pulley 50*b* of double output pulley 50 and an input pulley of an axle driving unit to be discussed below, so as to transmit power to an HST in the axle driving unit. An axle 7 is driven, in turn, by the power from engine E whose rotary speed has been changed steplessly by the HST. A pair of driving sprockets 67 are fixed onto axle 7, one at each end, outside of the left and right side plate portions of body frame 27. A pair of follower sprockets 68 are rotatably supported behind driving sprockets 67 by rear portions of a pair of track frames fixed onto the lower portion of body frame 27 (not shown). A pair of crawlers 29 are bound between driving sprockets 67 and follower sprockets 68, so as to construct a crawler type driving unit.

Figure 4:
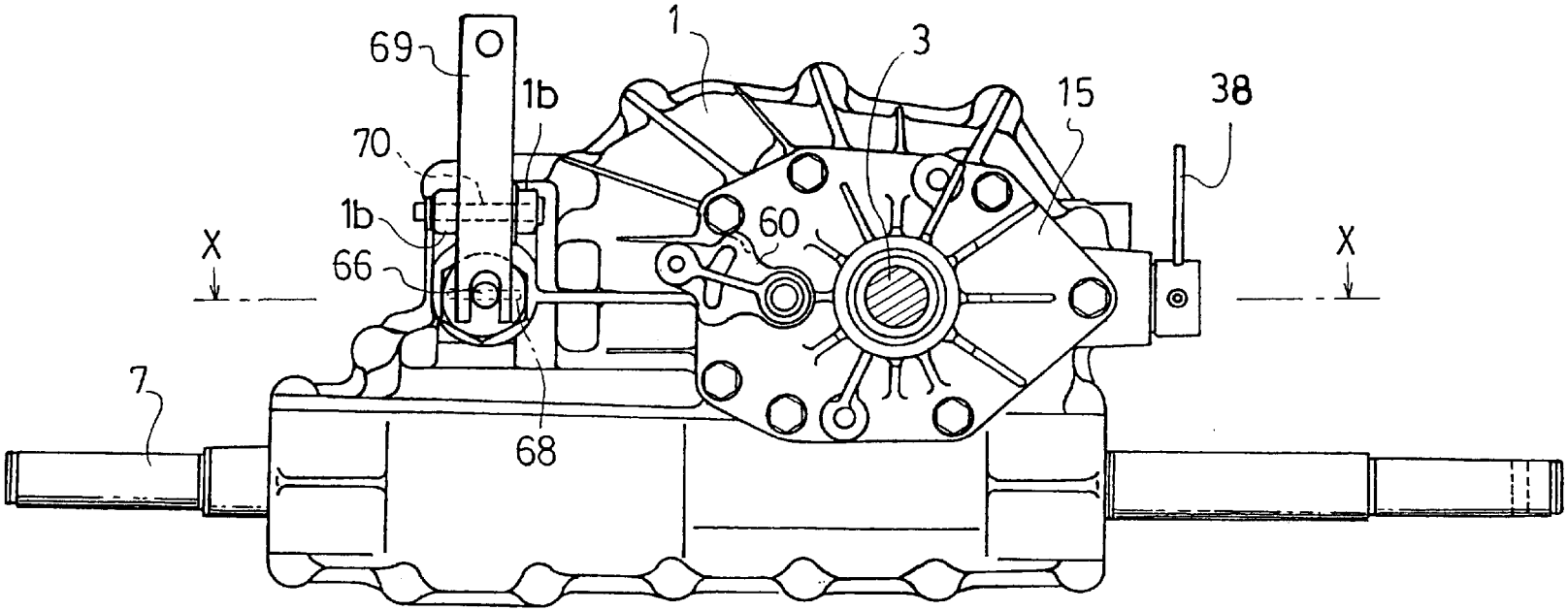
FIG. 4 is a front view of an axle driving unit for a snow thrower machine according to the present invention.
Figure 5:
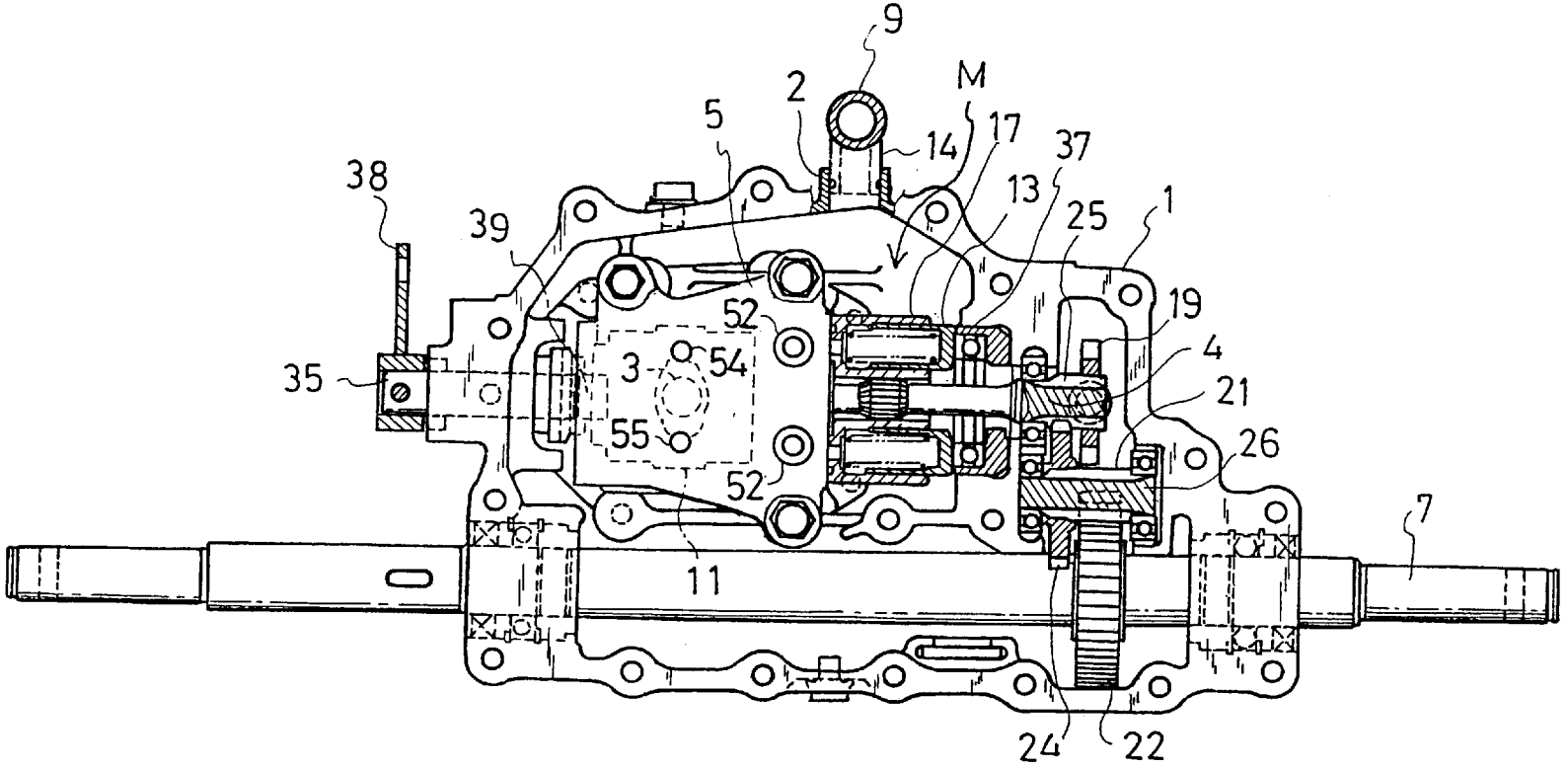
FIG. 5 is a rear view of the rear housing of an axle driving unit for a snow thrower machine according to the present invention.
Figure 6:
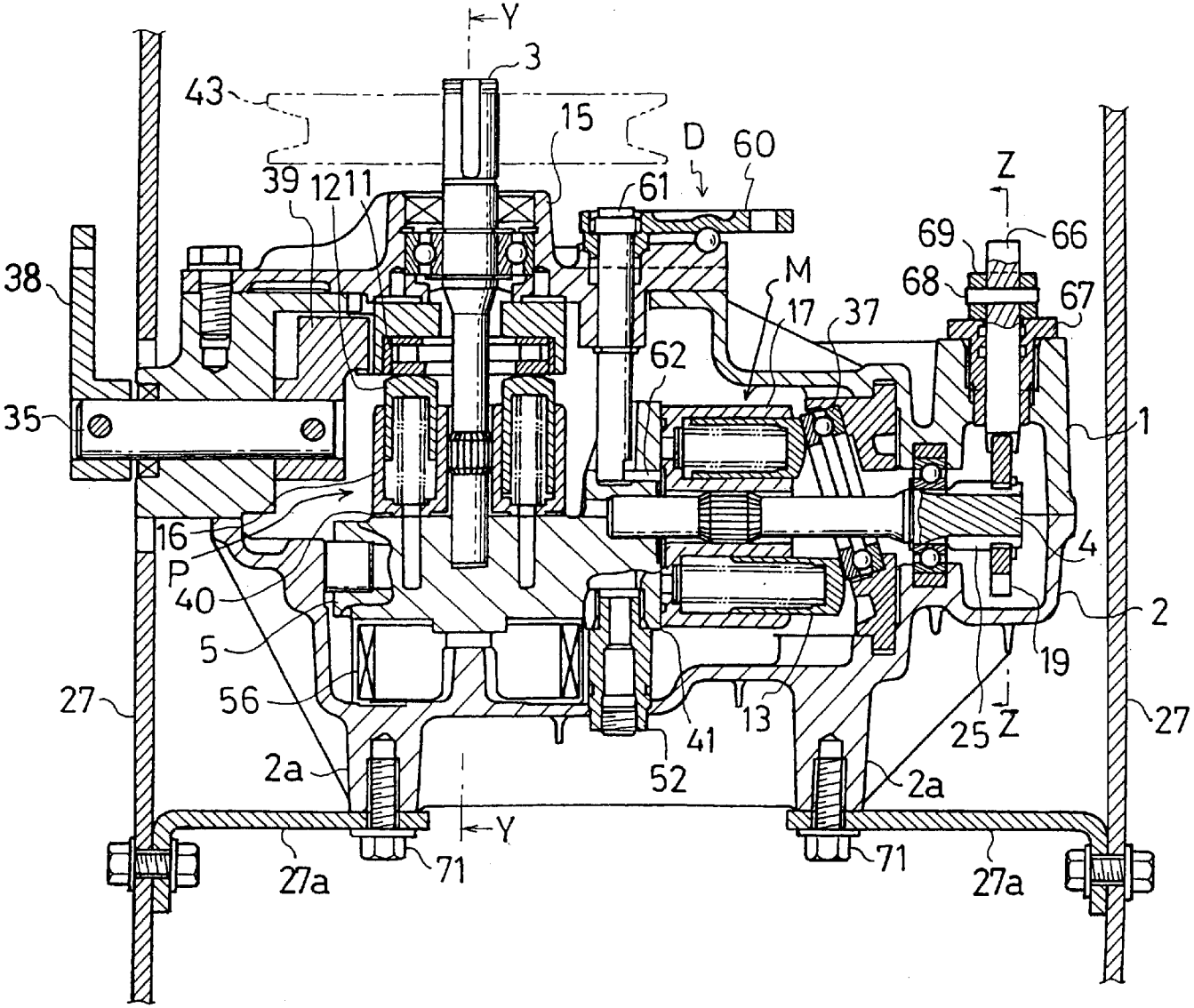
FIG. 6 is a cross-sectional view taken along line 6—6 of FIG. 4.
Figure 7:
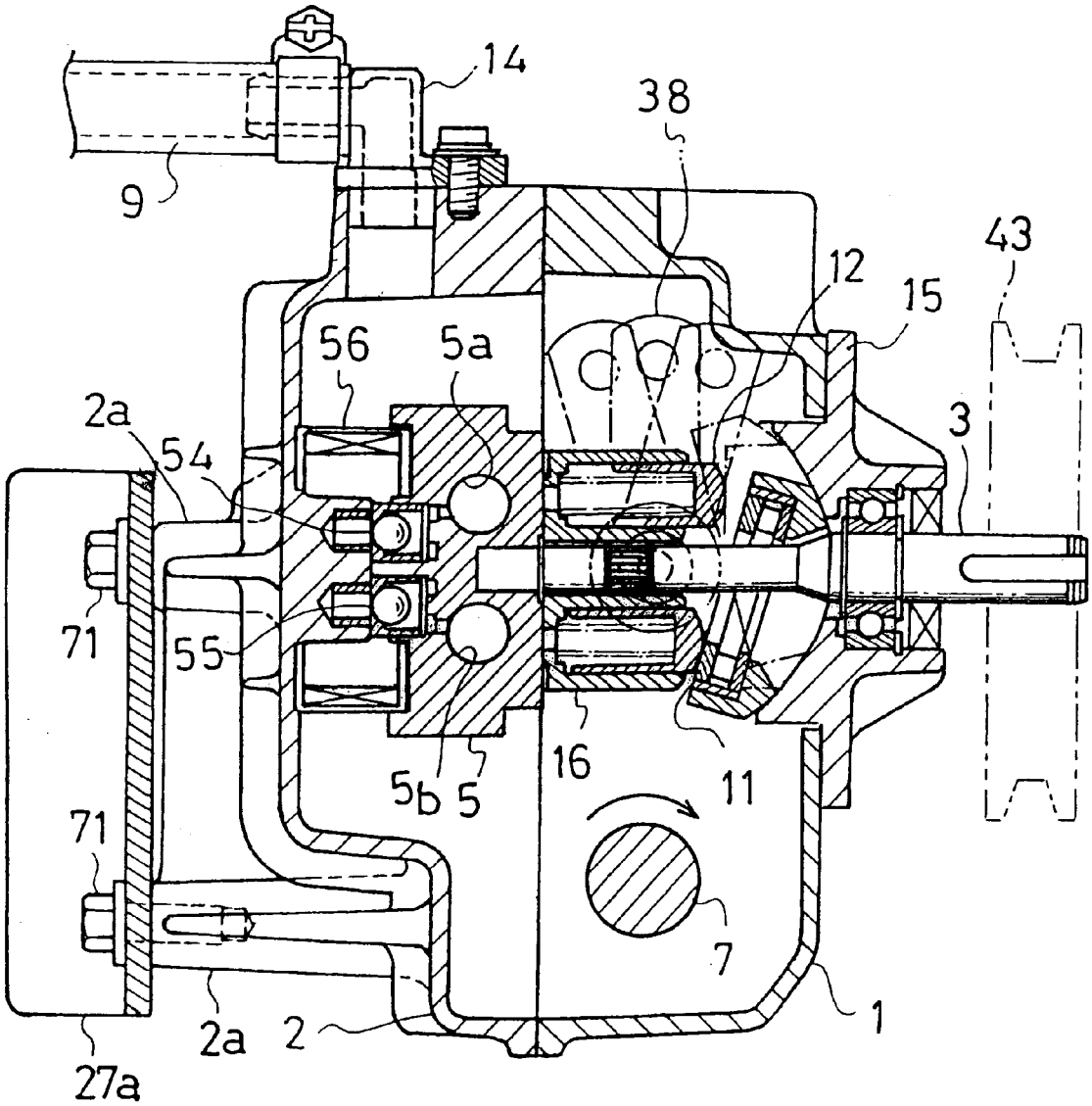
FIG. 7 is a cross-sectional view taken along line 7—7 of FIG. 6.

Next, explanation will be given of the axle driving unit of the present invention as shown in FIGS. 4 to 8. The housing for the axle driving unit consists of a front housing 1 and a rear housing 2. As shown in FIGS. 2, 6 and 7, the housing is attached to the machine body at the rear end of four bosses 2*a*, which project rearwardly, in parallel with each other, from the four comers of the rear surface of rear housing 2. Bosses 2*a* are bolted to a pair of brackets 27*a*, provided on the inner surface of the left and the right side plate portions of body frame 27, through bolts 71, so that the joint surface between front housing 1 and rear housing 2 is disposed vertically.

Also, as shown in FIGS. 5 and 6, bearings for a motor shaft 4 and a counter shaft 26 are disposed at the joint surface between front housing 1 and rear housing 2. As shown in FIG. 5, single axle 7 is disposed within the housing and is offset with respect to the joint surface between front housing 1 and rear housing 2, so as to be supported by the left and right side walls of front housing 1. Therefore, when the housing of the axle driving unit is attached to body frame 27 in the above mentioned manner, axle 7 is disposed in front of the joint surface. A final gear 22 is fixed on the portion of axle 7 toward the right side of the housing. Axle 7, which is a single axle in this embodiment, may alternatively be made of a pair of left and right axle parts, connected through a differential gear.

Figure 9:
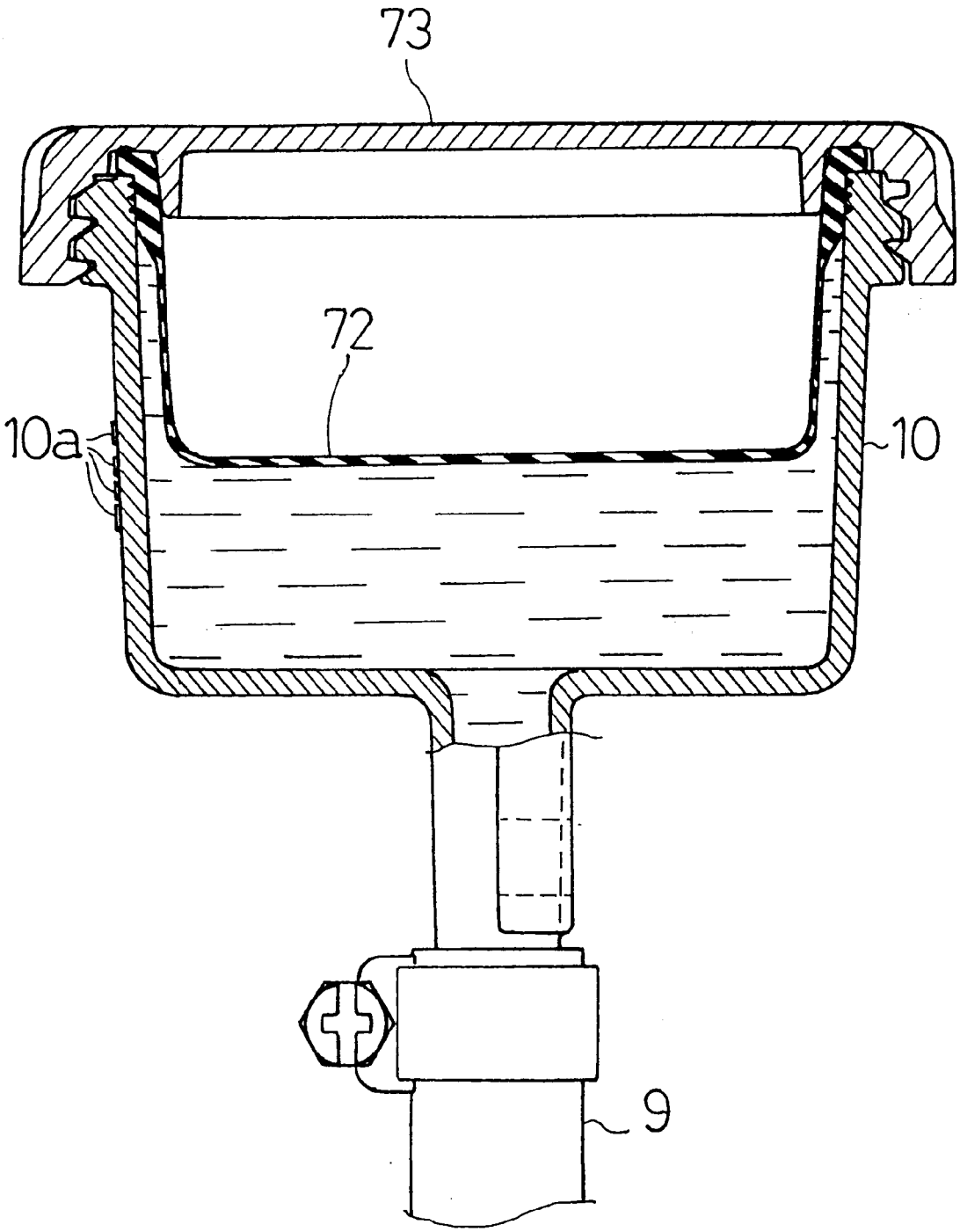
FIG. 9 is a front cross-sectional view of an oil reservoir for an HST of a snow thrower machine according to the present invention, at the normal temperature.
Figure 10:
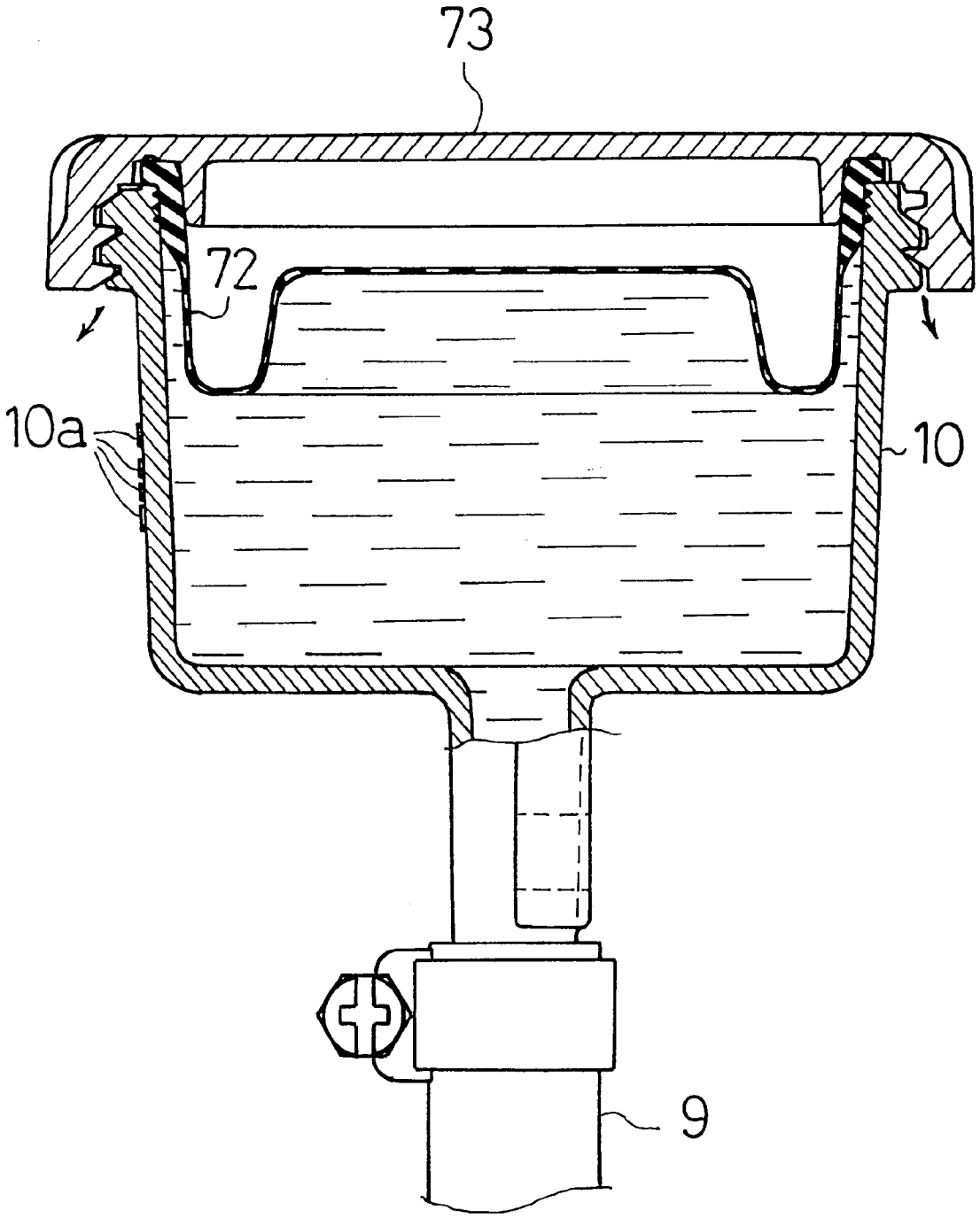
FIG. 10 is a front cross-sectional view of an oil reservoir for a HST of a snow thrower machine according to the present invention, when the volume of lubricating oil is increased.

The housing is filled with lubricating oil, so as to form an oil sump. A piping joint 14 is disposed on the upper portion of rear housing 2 as shown in FIG. 7. The oil sump is fluidly connected with reservoir 10, provided at rear of the machine body, through a piping 9 made of rubber hose or the like, as shown in FIG. 2. As shown in FIGS. 9 and 10, reservoir 10 is composed of a transparent resin cup. A gap between reservoir 10 and a cap 73 is blocked by a rubber bellows 72, which prevents lubricating oil from leaking therefrom. Cap 73 is screwed downwardly into reservoir 10, so that rubber bellows 72 is disposed therebetween. Graduations 10*a* are marked on the outer surface of reservoir 10 for measuring the quantity of lubricating oil therein.

Rubber bellows 72 is elastically changed according to changes in the volume of oil in the housing, corresponding to the vertical movement of the oil surface. A space between rubber bellows 72 and cap 73 in reservoir 10 communicates with the atmosphere through a breather groove (not shown).

In the initial state, rubber bellows 72 appears as shown in FIG. 9. When the HST in the axle driving unit is driven, the temperature of the lubricating oil in the oil sink within the housing increases and the volume of the lubricating oil expands. The expanding oil is absorbed into reservoir 10 and rubber bellows 72 is pushed upwardly. The air between rubber bellows 72 and cap 73 is released through the breather groove as shown by the arrow in FIG. 10, so that rubber bellows 72 is pushed up smoothly by the lubricating oil. Reservoir 10 can absorb an increase of lubricating oil to the extent shown in FIG. 10, thereby regulating the change in volume of the lubricating oil in the oil sump within the housing.

As shown in FIGS. 6 and 7, a center section 5, containing the HST, is disposed above axle 7 in the housing. Center section 5, which is L like shaped when viewed from above, forms a pump mounting surface 40 on a vertical front surface thereof for mounting a hydraulic pump P in one lateral direction thereof, and forms a motor mounting surface 41 on a vertical side surface thereof for mounting a hydraulic motor M in the other lateral direction thereof. Pump mounting surface 40 is disposed in the same plane as the joint surface between front housing 1 and rear housing 2, so that the HST is disposed substantially in the longitudinal middle of the housing. A pump shaft 3 is horizontally and longitudinally supported at the center of pump surface 40, as an input shaft of the HST, and a cylinder block 16 is rotatably and slidably mounted on pump surface 40. Pistons 12 are reciprocally inserted into a plurality of cylinder bores of cylinder block 16 through biasing springs, and the heads of pistons 12 abut against a thrust bearing of a movable swash plate 11, so as to construct a variable displacement hydraulic pump P. Pump shaft 3 is inserted into the central opening of movable swash plate 11, so as to be integrated with the rotary axis of cylinder block 16. Also, pump shaft 3 projects forward from the front surface of front housing 1 and has input pulley 43 fixed thereon. Power from engine E is transmitted to input pulley 43 through the above mentioned belt transmission system.

The quantity and direction of oil discharged from hydraulic pump P can be changed according to the slanting operation of the surface of movable swash plate 11 abutting against pistons 12 with respect to the rotary axis of cylinder block 16. The back surface of movable swash plate 11 is formed into an arcuate hemispherical convex and at the inside of a lid 15 fixed to front housing 1 is formed into an arcuate hemispherical recess corresponding to the shape of the arcuate hemispherical convex, so that the movable swash plate 11 can slide along the arcuate hemispherical recess of lid 15 when slanting thereof.

For the purpose of slanting movable swash plate 11, a control shaft 35 is disposed in parallel with axle 7. The inner end of control shaft 35 is journalled by the left side wall of front housing 1, a control lever 38 is fixed onto the outer end of control shaft 35, outside of the housing, and a swing arm 39 is fixed onto the portion of control shaft 35 in the housing. The utmost end of swing arm 39 engages with a groove portion formed at a side surface of movable swash plate 11. Accordingly, when control lever 38 is rotated along the longitudinal direction, with respect to the machine body, swing arm 39 is rotated vertically around control lever 35, thereby slanting movable swash plate 11, so that the output from hydraulic motor M can be changed. As shown in FIG. 2, control lever 38 interlocks with main speed changing lever 33 through rods 18 and 20, an arm 23 and the like.

The pressurized oil discharged from hydraulic pump P is charged into hydraulic motor M through oil passages within center section 5 to be discussed below. As shown in FIGS. 5 and 6, a cylinder block 17 is rotatably and slidably mounted on motor mounting surface 41. A plurality of pistons 13 are reciprocally inserted into a plurality of cylinder bores of cylinder block 17 through biasing springs, and the heads of pistons 13 abut against a fixed swash plate 37, sandwiched between front housing 1 and rear housing 2. Motor shaft 4 is horizontally disposed along the rotary axis of cylinder block 17, so as to integrally engage with cylinder block 17 and be not relatively-rotatable thereto, thereby forming hydraulic motor M. Thus, hydraulic pump P and hydraulic motor M are disposed on center section 5, so that the HST is disposed substantially in the center of the housing, as shown in FIGS. 6 and 7.

Center section 5 is fixed to front housing 1 by three bolts as shown in FIG. 5. A pair of kidney-shaped ports are open around the bearing portion at pump mounting surface 41 of center section 5, so as to allow therethrough the passage of oil discharged from and charged to cylinder block 16. A pair of kidney-shaped ports are also open at motor mounting surface 41, so as to allow therethrough the passage of oil discharged from and charged to cylinder block 16. For the purpose of connecting the kidney-shaped ports of pump mounting surface 40 and motor mounting surface 41 with each other, a pair of straight oil passages 5*a* and 5*b* are bored laterally therein, in parallel with each other, so as to construct a closed fluid circuit.

Oil supply passages, which diverge perpendicularly from intermediate portions of oil passages 5*a* and 5*b*, are open at the rear surface of center section 5 through check valves 54 and 55. A ring-shaped oil filter 56 is disposed between rear housing 2 and center section 5, around check valves 54 and 55, so as to filter operating oil sucked into center section 5. The open ends of a pair of pressure pourings 52 connected with oil passages 5*a* and 5*b* are accessible from the rear surface of rear housing 2 and plugs are inserted therein.

For the purpose of enabling axle 7 to run idle when the snow thrower machine is drawn, a bypass operating lever 60, for opening oil passages 5*a* and 5*b* to the oil sink, is disposed at the front surface of front housing 1. As shown in FIG. 6, a base portion of bypass operating lever 60 is fixed onto a front end of a bypass lever shaft 61, which is rotatably journalled laterally by a front wall of lid 15 or front housing 1. A detent system D is disposed between bypass operating lever 60 and front housing 1, selectable between an open position and a closed position. Bypass lever shaft 61 is extended so that the rear end portion thereof is disposed at the back of motor mounting surface 41 within center section 5. The peripheral surface of the rear end portion of bypass lever shaft 61 partially forms a flat surface.

A throughout bore is open slightly ahead of the center of motor surface 41 of center section 5 and between the kidney ports thereof. A push pin 62 is slidably supported in the throughout bore, in parallel with the rotary axis of cylinder block 17. One end of push pin 62 abuts against the back surface of cylinder block 17 and the other end thereof abuts against the flat surface of the rear end portion of bypass lever shaft 61. Accordingly, when bypass operating lever 60 is operated, bypass lever shaft 61 is rotated, so that the peripheral surface thereof pushes push pin 62, thereby lifting cylinder block 17 and making a gap between the back surface of cylinder block 17 and motor mounting surface 41. Thus, the closed fluid circuit is opened to the oil sink within the housing and motor shaft 4 can freely rotate.

A gear 25 with a discal lock member 19 is disposed around the utmost end portion of motor shaft 4. Gear 25 engages with a large diametric gear 24 fixed onto counter shaft 26. A small diametric gear 21 notched on counter shaft 26 engages with final gear 22, so as to reduce the rotational speed of motor shaft 4 and transmit power to axle 7. Axle 7 is disposed ahead and below hydraulic motor M from a perspective view, so as to reduce the longitudinal length of the housing as much as possible. Additionally, axle 7 is disposed ahead and below counter shaft 26 from a perspective view, so that the vertical and longitudinal lengths of the housing can be reduced, thereby raising the lowest position of the snow thrower machine provided with the above mentioned axle driving unit.

Figure 8:
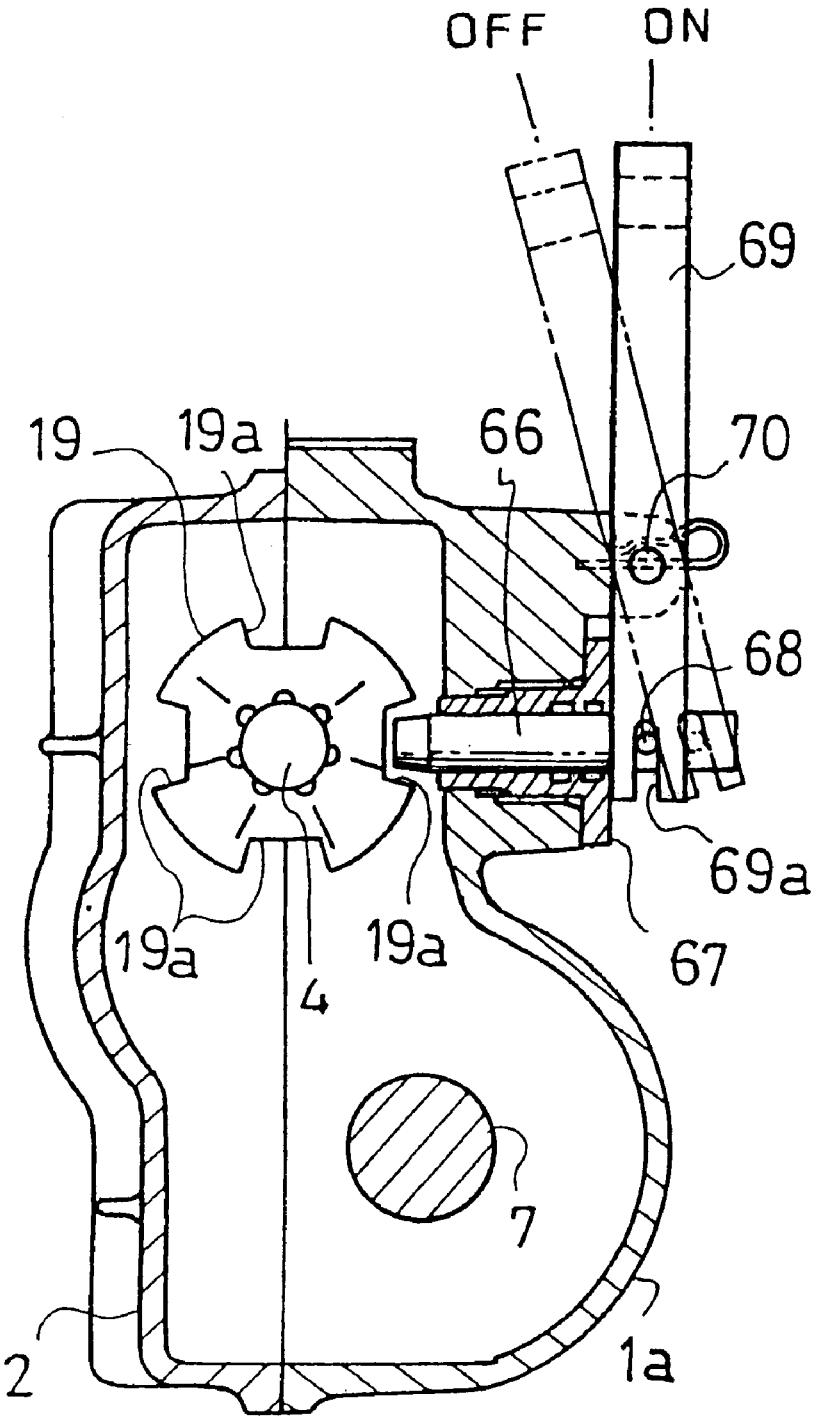
FIG. 8 is a cross-sectional view taken along line 8—8 of FIG. 6.

As shown in FIG. 8, a plurality of (four in this embodiment) recessed portions 19*a* are provided on the peripheral surface of lock member 19 at regular intervals. A lock pin 66 is slidably supported longitudinally by the front wall of front housing 1 through a bushing 67. The inner end of lock pin 66 faces recessed portions 19*a* and is disposed perpendicularly to motor shaft 4. The outer end of lock pin 66 projects out of the housing and an engaging pin 68 is fixed thereon. As shown in FIGS. 4 and 8, an intermediate portion of a lock lever 69 is pivoted between a pair of left and right brackets lb disposed on the front wall of front housing 1 through the use of a pin 70. A cut out portion 69*a* formed at the lower end of lock lever 69 is engaged with engaging pin 68.

Accordingly, when lock lever 69 is rotated frontward, the outer end of lock pin 66 is pushed in and the inner end thereof is inserted into recessed portion 19*a*, so that motor shaft 4 cannot be rotated, thereby restricting the rotation of axle 7.

Furthermore, lock lever 69 is disposed in a vacant space ahead of the right side portion of the housing above expanded portion la of front housing 1, which covers axle 7, so that lock lever 69 does not interfere with other levers, rods and the like.

In the construction of the snow thrower machine according to the present invention, since center section 5 is disposed so that the joint surface between front housing 1 and rear housing 2 is coincident with the plane of pump mounting surface 40, the HST can well balanced longitudinally. Also, since axle 7 is supported by front housing 1 below hydraulic pump P, axle 7 can be disposed as high as possible, thereby raising the lowest point on the snow thrower machine and providing a compact housing for the axle driving unit and axle 7.

Furthermore, the snow thrower machine can be prevented from skidding when in neutral or due to a leak of operating oil through a parking brake system constructed according to the present invention, where lock pin 66, which is supported by the front wall of front housing 1, can be engaged with lock member 19, fixed on motor shaft 4. Also, since the parking brake system is disposed above expanded portion l*a*, which contains axle 7, it can be disposed compactly and can be prevented from interfering with other levers, rods and the like.

What is claimed is:

1. A hydrostatic axle driving unit for propelling a snow thrower machine comprising:

an axle driving unit housing consisting of a front half housing and a rear half housing joined together along a vertical joint surface;

a hydraulic pump, disposed in said axle driving unit housing, having a longitudinal input shaft for receiving power from the engine;

a hydraulic motor, disposed in said axle driving unit housing, receiving pressurized oil from said hydraulic pump;

a center section, disposed in said axle driving unit housing, having a pump mounting surface formed on a front surface, on which said hydraulic pump is mounted, and a motor mounting surface formed on a side surface, on which said hydraulic motor is mounted, wherein said pump mounting surface is disposed parallel to said vertical joint surface between said front half housing and said rear half housing; and an axle disposed in said axle driving unit housing below said hydraulic pump and driven by said hydraulic motor.

2. An axle driving unit for propelling a snow thrower machine comprising:

an axle driving unit housing;

an axle disposed in said axle driving unit housing;

a hydraulic pump, disposed in said axle driving unit housing, receiving power from the engine;

a hydraulic motor, disposed in said axle driving unit housing, receiving pressurized oil from said hydraulic pump, wherein power is transmitted from a motor shaft of said hydraulic motor to drive said axle; and a parking brake system composed of a discoid first lock member and rod-shaped second lock member, wherein said first lock member housing a plurality of recesses aligned on its periphery is disposed within said axle driving unit housing so as to be fixed to said motor shaft, and wherein said second lock member is supported by said axle driving unit housing so as to be slidably engaged into any of said recesses.

3. A snow thrower machine comprising:

a first crawler;

a second crawler;

a body frame disposed between said first crawler and said second crawler;

an engine, mounted on said body frame, having an output shaft oriented longitudinally with respect to said body frame;

an axle driving unit for propelling said snow thrower machine, disposed on said body frame, having an axle driving unit housing, an input shaft, which projects forward from said axle driving unit housing, and a pair of sprockets for said crawlers, which are fixed onto opposite ends of an axle supported within said axle driving unit housing, wherein said axle driving unit housing consists of a first housing and a second housing, joined together along a joint surface, wherein said joint surface between said first housing and said second housing is disposed substantially vertically when said axle driving unit housing is mounted onto said body frame;

a snow thrower unit, disposed adjacent said axle driving unit, having an input shaft, which projects rearward from said snow thrower unit, wherein said output shaft of said engine, said input shaft of said axle driving unit and said input shaft of said snow thrower unit are substantially parallel with one another;

a first power transmitting means connecting said output shaft of said engine and said input shaft of said axle driving unit with each other;

a second power transmitting means connecting said output shaft of said engine and said input shaft of said snow thrower unit with each other; and an HST, disposed in said axle driving unit housing, constructed so as to fluidly connect a hydraulic pump, disposed in said axle driving unit housing, which is driven by said input shaft of said axle driving unit, and a hydraulic motor, disposed in said axle driving unit housing, which is connected with said axle for driving said axle, wherein said hydraulic pump and said hydraulic motor are disposed above said axle and oriented in a plane parallel to the longitudinal axis of said axle.

4. A snow removing machine as set forth in claim 3, further comprising:

a control lever for said HST, disposed on a side surface of said housing, so as to be rotatable around an axis substantially parallel with a longitudinal axis of said axle; and a speed changing lever connected to said control lever, disposed adjacent a control handle of said snow removing machine.

5. A snow thrower machine as set forth in claim 3, further comprising:

a stay provided on said body frame, wherein said second housing is attached to a surface of said stay.

* * * * *